US008539803B2

(12) United States Patent
Widén

(10) Patent No.: US 8,539,803 B2
(45) **Date of Patent: *Sep. 24, 2013**

(54) CYLINDER LOCK WITH PROFILED KEYWAY

(75) Inventor: Bo Widén, Torshälla (SE)

(73) Assignee: Winloc AG, Zug (CH)

( * ) Notice: Subject to any disclaimer, the term of this patent is extended or adjusted under 35 U.S.C. 154(b) by 161 days.

This patent is subject to a terminal disclaimer.

(21) Appl. No.: 13/184,305

(22) Filed: Jul. 15, 2011

(65) Prior Publication Data

US 2011/0271723 A1 Nov. 10, 2011

Related U.S. Application Data

(60) Continuation of application No. 13/080,339, filed on Apr. 5, 2011, now Pat. No. 8,205,473, which is a division of application No. 12/866,204, filed as application No. PCT/SE2010/050189 on Feb. 18, 2010, now Pat. No. 8,210,009.

(30) Foreign Application Priority Data

Feb. 18, 2009 (SE) ..... 0900207
Jan. 4, 2010 (WO) ..... PCT/SE2010/050006

(51) Int. Cl.
*E05B 27/00* (2006.01)

(52) U.S. Cl.
USPC ..... 70/490; 70/493; 70/495; 70/405; 70/407; 70/409

(58) Field of Classification Search
USPC ..... 70/492–495, 405, 407–409
See application file for complete search history.

(56) References Cited

U.S. PATENT DOCUMENTS

| | | | | |
|---|---|---|---|---|
| 4,638,651 | A * | 1/1987 | Surko, Jr. | 70/495 |
| 4,756,177 | A | 7/1988 | Widen | |
| 4,815,307 | A * | 3/1989 | Widen | 70/493 |
| 5,640,865 | A | 6/1997 | Widen | |
| 5,715,717 | A | 2/1998 | Widen | |
| 5,809,816 | A * | 9/1998 | Widen | 70/493 |

(Continued)

FOREIGN PATENT DOCUMENTS

| | | | |
|---|---|---|---|
| DE | 44 22 093 | C2 | 1/1996 |
| WO | WO 01/96696 | A1 | 12/2001 |
| WO | WO 2005/028789 | A1 | 3/2005 |

*Primary Examiner* — Suzanne Barrett
(74) *Attorney, Agent, or Firm* — Birch, Stewart, Kolasch & Birch, LLP

(57) ABSTRACT

A cylinder lock with a rotatable key plug (112) having a profiled keyway (113,116), the keyway being configured to accommodate an elongated, substantially flat key blade (120) with a longitudinal groove (122). The keyway in the key plug has two opposite lateral sides and a profile rib (150) located at a substantially flat lateral side. The profile rib has a downwardly projecting tongue portion (161) configured to extend inside the profile groove (122) upon inserting the key (120) into the key plug (112) of the lock, and the tongue portion of the profile rib is extended downwardly into a lowermost, massive end portion (162) which has two opposite side surfaces (163,164) and a lowermost transverse end surface (165) which is substantially flat or slightly curved. The lowermost, massive end portion (162) extends downwardly in a direction which is parallel to a central longitudinal plane (A') through said keyway, and the lowermost transverse end surface (165) extends substantially in a plane which is perpendicular to a the central longitudinal plane (A').

38 Claims, 8 Drawing Sheets

(56) References Cited

U.S. PATENT DOCUMENTS

| | | | | |
|---|---|---|---|---|
| 5,845,525 | A * | 12/1998 | Widen | 70/493 |
| 6,134,929 | A * | 10/2000 | Widen | 70/493 |
| 6,851,292 | B2 * | 2/2005 | Kruhn | 70/409 |
| 7,370,502 | B2 * | 5/2008 | Widen | 70/493 |
| 7,665,337 | B1 * | 2/2010 | Widen | 70/409 |
| 7,788,956 | B2 * | 9/2010 | Field et al. | 70/340 |
| 2008/0250830 | A1 | 10/2008 | Field et al. | |

* cited by examiner

CYLINDER LOCK WITH PROFILED KEYWAY

This application is a Continuation of application Ser. No. 13/080,339 filed on Apr. 5, 2011, now U.S. Pat. No. 8,205,473 which is a Divisional application of U.S. application Ser. No. 12/866,204, filed on Aug. 4, 2010, now U.S. Pat. No. 8,210,009, issued Jul. 3, 2013, which claims priority to 0900207-2 SE filed on Feb. 18, 2009, the entire contents of all of the above applications is hereby incorporated by reference.

FIELD AND BACKGROUND OF THE INVENTION

The present invention relates to a cylinder lock with a rotatable key plug having a profiled keyway, said keyway being configured to accommodate an elongated, substantially flat key blade having a longitudinal profile groove, wherein said keyway has two opposite lateral sides, one of which is substantially flat with a lower part thereof lying substantially in the same plane as an upper art thereof, and a profile rib located at said substantially flat lateral side, said profile rib having a downwardly projecting tongue portion configured to extend inside said profile groove upon inserting said key into said keyway of said key plug of the lock.

Such a lock with a keyway having a profile rib is previously known, e.g. from U.S. Pat. No. 5,715,717 (Widén) or U.S. Pat. No. 5,640,865 (Widén). Such locks and keys have proven to be very useful in that they provide an improved security. The keyway profile is quite distinguished from conventional keyways, and it is rather difficult to copy the associated keys. Moreover, they permit a great variation of the cross-sectional profile, which is a great advantage.

OBJECT OF THE INVENTION

However, over time, there is a constant need for further distinguishing profiles and many more possible variations thereof.

A further object of the invention is to make it even more difficult to copy such associated keys with ordinary lock smith tools.

SUMMARY OF THE INVENTION

In order to achieve these objects, said tongue portion of the profile rib is extended downwardly into a lowermost, massive end portion which has two opposite side surfaces and a lowermost transverse end surface, which is substantially flat or slightly curved, said lowermost, massive end portion extending downwardly in a direction which is parallel to a central longitudinal plane through said keyway, and said lowermost transverse end surface extending substantially in a plane which is substantially perpendicular to a said central longitudinal plane.

Preferably the vertical dimension of said tongue portion, measured in a plane parallel to said lateral sides of said keyway, is greater than half of the smallest height of said profile rib adjacent to said one lateral side of the keyway, also measured in a plane being parallel to said lateral sides of said keyway. The side surfaces of the extended tongue portion of the profile rib should be substantially parallel to said lower part of said one lateral side of said keyway, so that the corresponding portions of the associated key form massive and strong material portions. The lowermost end portion of the tongue portion of the profile rib may have a substantially rectangular cross-section, a substantially circular cross-section, with a relatively large curvature, or some other configuration.

In this way, the material of the profile rib and the associated key blade is used in an optimum way, and a new kind of profile is obtained, and it will be very difficult to copy such associated keys, especially if they are produced by stamping and milling. A cutting disc is normally not enough. Rather, it will be necessary to use broaching tools and a well-controlled use of such tools in order to secure exact dimensions of a pocket-like extension of the groove accommodating the extended tongue portion of the profile rib. This is of great importance for key control and high security to the end user of the key.

With such a configuration of the keyway, many advantages are obtained at the same time, as will be explained further below.

Other preferable features are stated in the dependent claims and will appear from the detailed description below.

BRIEF DESCRIPTION OF THE DRAWINGS

The invention will be described more fully below with reference to the appended drawings.

FIGS. 10*a*-18*a* and FIGS. 10*b*-18*b* are cross-sectional views of some additional embodiments of the profiled key and a lock according to the invention, respectively, and FIGS. 19*a*-28*a* and FIGS. 19*b*-28*b* are similar cross-sectional views of some further modified embodiments of the profiled key and a lock according to the invention, respectively.

BRIEF DESCRIPTION OF SOME PREFERRED EMBODIMENTS

Figure 1:
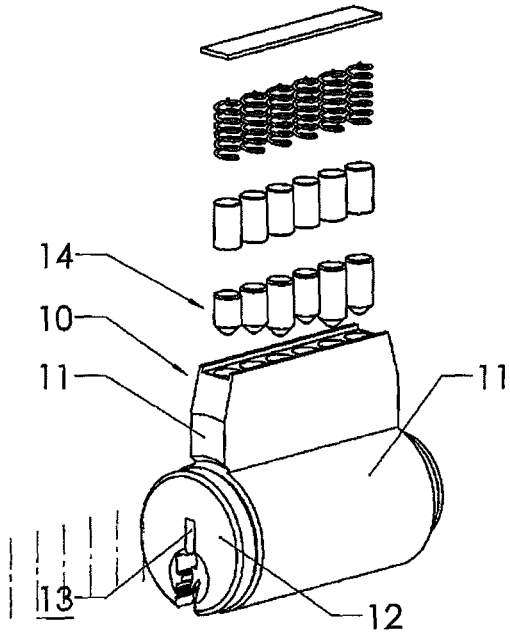
FIG. 1 and FIG. 2 illustrate a prior art lock and key combination.
Figure 2:
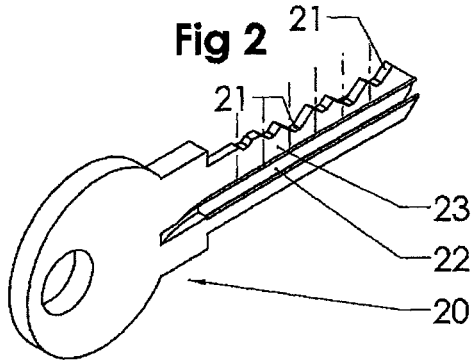
Figure 3:
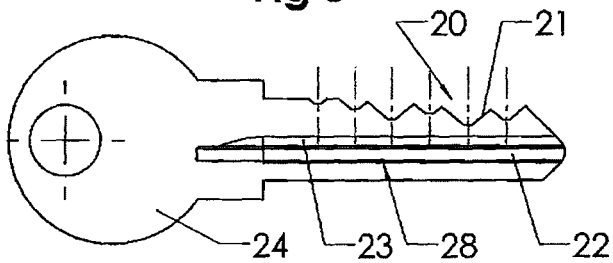
FIG. 3 shows a side view of the key illustrated in FIG. 2.

FIGS. 1 through 5 show a prior art lock and key system with a key blade having an undercut profile groove in a side surface thereof, such as the system disclosed in U.S. Pat. No. 5,715,717 (widen). The lock 10 is of the kind having a housing 11 with a rotatable key plug 12 is accommodated in a cylindrical bore of the housing. In the key plug 12, there is a central longitudinal keyway 13 having a sectional profile corresponding to an associated key 20 provided with conventional recesses 21 at a side surface 23 of the key blade. As appears from FIG. 3, the key also has a grip portion 24.

Figure 4:
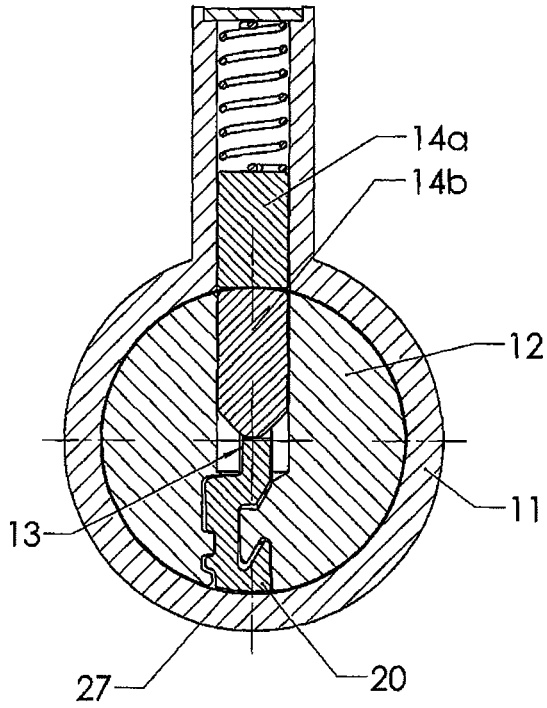
FIG. 4 is a cross-section through the prior art lock with an inserted key.

The operation of the lock is more readily understood from the cross-sectional view in FIG. 4. The key plug 12 is rotatable within the housing 11 and can be locked against rotation by means of a longitudinal row of upper and lower locking pins 14*a*, 14*b*, Each pair of such locking pins can be positioned with their abutting end surfaces at the shear line between the key plug 12 and the housing 11. In this position, as shown in FIG. 4, the key plug 12 is rotatable. Here, as is well-known in the art, the locking pins are positioned so as to release the lock by means of a properly cut key 20.

Figure 5:
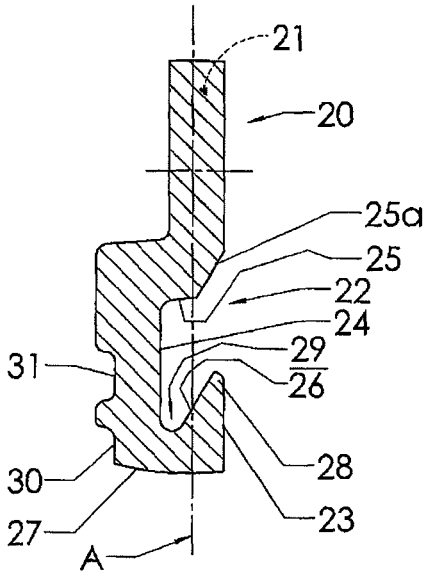
FIG. 5 is a cross-sectional view of the prior art key blade.
Figure 6:
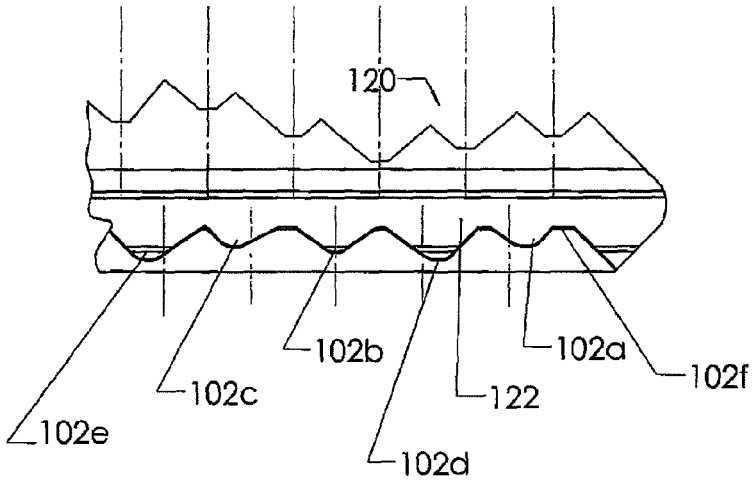
FIG. 6 shows a side view of a profiled key to be used in a cylinder lock according to the present invention for an embodiment with a wave-like code pattern on the key.

The full profile of the key 20 (of prior art design) is illustrated in FIG. 5, as disclosed e.g. in the above mentioned U.S. Pat. No. 5,715,717 (Widén). Accordingly, this prior art key has a longitudinal profile groove 22 extending longitudinally along the key blade at a depth which is slightly greater than half the thickness of the key blade. In FIG. 5, the central plane of the key blade is denoted "A". The longitudinal groove 22 has an inner wall 24 and opposite walls 25 and 26. One of these opposite walls, in particular the wall or surface 26 located closest to the base edge 27 of the key blade is undercut and extends in a plane being inclined so as to face inwardly towards the inner wall or surface 24. This lower side wall 26 of the undercut groove 22 forms an inside wall of a ridge portion 28, the outside of which forms part of the above mentioned side surface 23 of the key blade.

The prior art key blade shown in FIGS. 2, 3, 4 and 5 also has two further longitudinal grooves 30 and 31 and a longitudinal rib therebetween on the other side of the key (to the left in FIG. 5).

The undercut portion 29 of the longitudinal groove 22 has many advantages, as explained in the above-mentioned U.S. Pat. No. specification 5,715,717 (Widen), especially with regard to increasing the number of possible profile variations, improved resistance against picking the lock and high security against unauthorized key copying.

According to the present invention and as illustrated in FIG. 6 through 9, a further improvement resides in a modification of the undercut groove and the corresponding keyway of the lock. This modification comprises an expansion or extension of the innermost part of the undercut portion of the groove 122 (FIG. 7*a*) so as to form a longitudinal pocket-like configuration 135. In these Figures, all reference numerals relating to the key correspond to those shown in FIG. 5, although they have been supplemented with the digit "1" before the number given in FIG. 5.

Similarly, the keyway of the key plug 112 includes an upper portion 113, with opposite lateral sides 117, 117', and a lower portion 116, with opposite lateral sides 118, 118'. The upper and lower lateral sides 117, 118 (to the right in FIG. 7*b*) lie in the same plane, from which a profile rib 160 extends into keyway 113, 116 so as to be accommodated by the undercut groove 122 of the key blade 120 upon insertion of the latter into the keyway.

The profile rib 150 is configured, in its geometrical cross-sectional shape, so as to be complementary to the cross-sectional shape of the groove 122 in the key blade, with a slight play therebetween to allow for manufacturing tolerances and permitting the key blade to slide longitudinally in the keyway.

Accordingly, the profile rib 150 has a downwardly projecting tongue 161 which is extended further down into a lowermost end portion 162. This lowermost end portion is substantially uniformly wide, so as to fit inside the extended pocket 135 of the groove 122 of the key blade, and has substantially parallel, opposite side surfaces 163, 164, oriented substantially in parallel to the lateral sides 117, 118 of the keyway, and a transverse end surface 165, which is substantially flat or slightly curved and which is substantially perpendicular to the lateral sides 117, 118 of the keyway.

The downwardly extended, lowermost end portion 162 may be substantially rectangular in shape (as in the embodiment shown in FIG. 7*b*) but it may alternatively be circular in cross-section or it may have some other geometrical shape, within the scope of the appended claims.

Figure 7A:
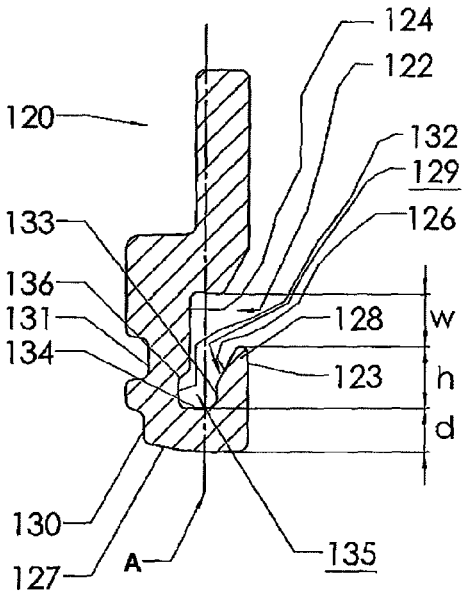
FIG. 7*a* is a cross-section through the key of FIG. 6.
Figure 7B:
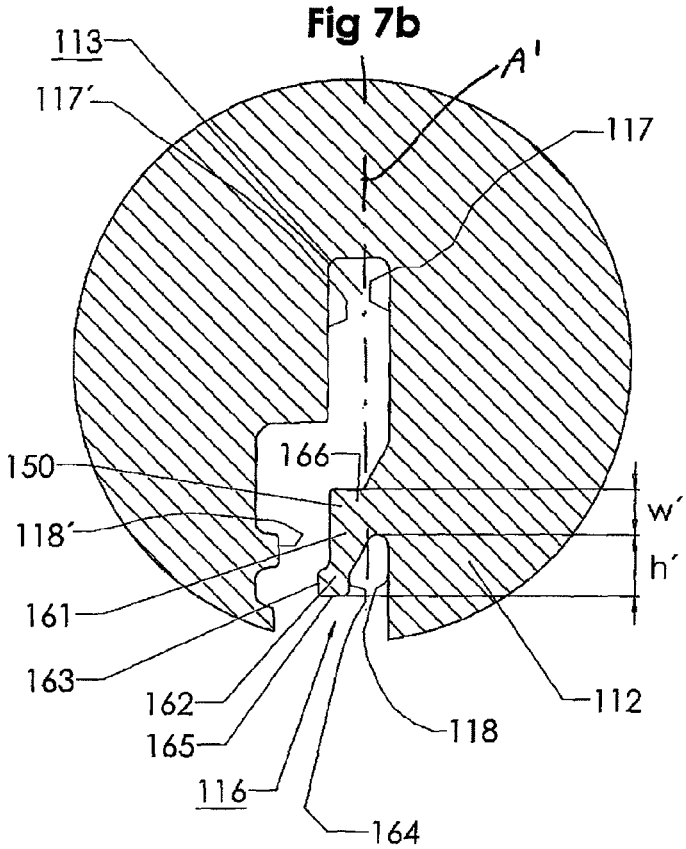
FIG. 7*b* shows a cross-section through a key plug in a lock according to the invention.

As appears from FIGS. 7*a* and 7*b*, the geometrical shapes of the profile groove 122 in the key 120 and the keyway 113, 116 of the key plug 112 are complementary in shape. Thus, in this particular embodiment, the downwardly extended pocket-like configuration 135 of the modified undercut groove 122, is substantially rectangular in cross-section, with opposite lateral walls 132 and 133 being parallel to each other, and a lowermost transverse end wall 134, being parallel to the lower edge surface 127 of the key blade and facing upwardly in the direction of the central plane A of the key blade. Thus, the lowermost transverse end wall 134 is substantially perpendicular to the central plane A, and the transverse end surface 165 is perpendicular to a central plane A' in the keyway.

The innermost lateral wall 132 of the pocket-like extension 135 adjoins with the inner wall 124 of the undercut groove, but is slightly displaced and expanded inwardly (away from the groove opening) so as to form a step 136, whereas the opposite lateral wall 133 forms the inside wall of the ridge portion 128, in parallel to the external side surface 123 of the key blade.

Thus, the surfaces 123, 133 and 132 are substantially parallel to each other.

The ridge portion 128 is somewhat longer, measured in parallel to the central plane A of the key blade, than the prior art structure (FIG. 5). More particularly, the ridge portion 128 has a vertical dimension h, which is more than half of the smallest width w of the undercut groove 122, this smallest width w being measured as a perpendicular projection onto the bottom wall 124 of the longitudinal groove 122.

Correspondingly, the downwardly extended part of the profile rib has a vertical extension h' which is greater than half of the (smallest) vertical extension w' of the base portion 166 of the profile rib.

Also, the vertical dimension h of the ridge portion 128 of the key blade is greater than the distance d between the lowermost transverse end wall 134 and the lower edge surface 127 of the key blade. This structure is advantageous for several reasons:

- by varying the width, depth (in the plane A) and longitudinal extension of the pocket-like configuration and the corresponding tongue 161 of the key plug 112, the profile shape can be varied considerably;
- because of the opposite lateral wall portions 132, 133, the total width of the undercut portion of the profile groove 122 of the key blade can be accommodated in a limited region laterally, so that the total width of the key blade can be kept rather small. It appears from FIGS. 5 and 7 that the total width of the new key blade is about the same;
- the corresponding tongue portion 161, which forms a part of the longitudinal rib 150 at a side wall of the keyway (see FIGS. 8 and 9), will be stronger and does not have to have a pointed or sharp end portion, as in the prior art structure (compare FIG. 4);
- the pocket-like extension 135 of the undercut portion of the groove 122 will make it much more difficult to make copies of such keys, since it is not sufficient to use only a cutter disk. Normally, other tools also have to be used. Accordingly it will be difficult for others than specialized manufacturers to produce such key blanks;
- the relatively long vertical extension of the ridge portion 128, in parallel to the central plane A of the key blade, will make it possible to cut rather deep recesses in the ridge portion. Accordingly, just like in the prior art embodiment of FIGS. 1-5, it is possible to provide many vertical levels of code recesses in this material region, see FIG. 6. Of course, this will also facilitate lock and key systems having a very high number of code combinations.

Figure 8:
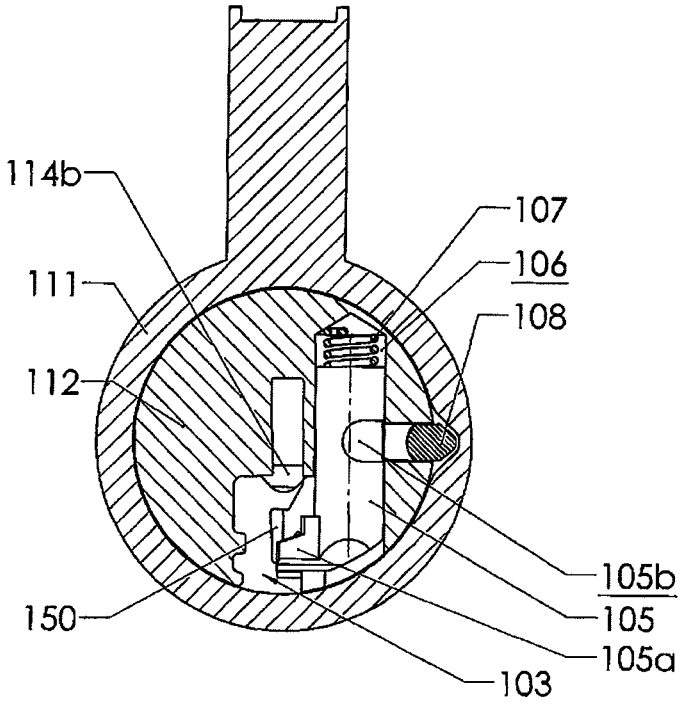
FIG. 8 is a cross-section through the lock with a key plug and a side tumbler.
Figure 9:
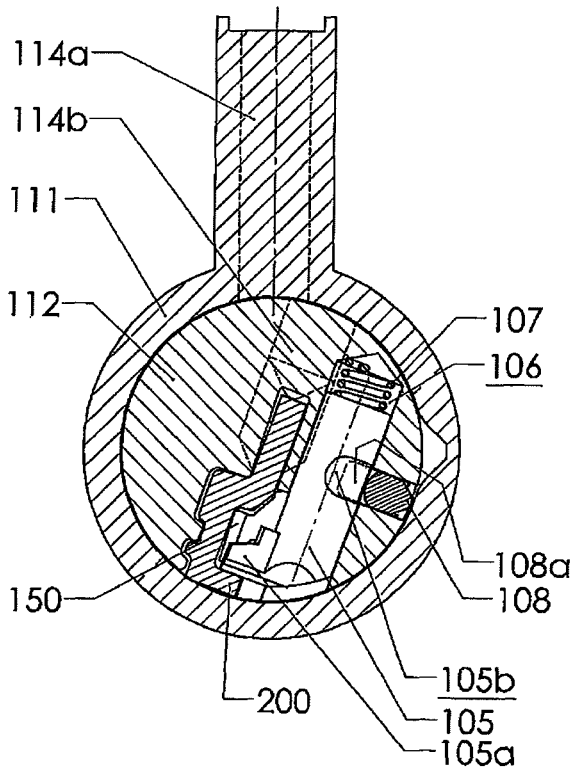
FIG. 9 is a similar view of a lock an a key inserted into the lock.

In FIGS. 8 and 9 there is shown an embodiment with a side locking tumbler 105, which is guided in a cylindrical cavity 106 in the rotatable key plug 112. In principle, the arrangement is similar to those disclosed in the U.S. Pat. Nos. 4,756,177 (Widén) and 5,715,717 (Widen).

The parts that correspond to the previous, prior art embodiment (FIG. 5) have been given the same reference numerals, with the digit "1" added before the numbers shown in FIG. 5.

Accordingly, the side tumbler 105 is rotatable around its cylindrical axis, so that a transversally projecting finger 105*a* will pivot back and forth when the projecting finger 105*a* follows a wave-like coded surface on the side of the key blade (see FIG. 6), in this case in the ridge portion 128 (see FIG. 7). When the side tumbler 105 is correctly positioned, a recess 105*b* in its cylindrical surface will register with corresponding projections 108*a* on a side bar 108 (FIG. 9). In this way, the side bar may move radially inwards so as to permit rotation of the key plug 112.

The projecting finger 105*a* on the side tumbler 105 will contact the wave-like code pattern (see FIG. 6) on the side of the key blade 120, while pivoting back and forth and also moving vertically up and down. When the key blade is fully inserted, the various side tumbler projections 105*a* will be located in the concavities 102*a*, 102*b*, 102*c* 102*d*, 102*e* and possibly also (or alternatively) onto an upper code surface portion 102*f* at an uppermost extra code level. Such an upper, extra code level is disclosed in the published international patent application WO2005/028789 (Winloc et al).

According to the present invention, there is provided an even deeper pocket-like extension 135 of the undercut portion of the profile groove, in parallel to the central vertical plane A of the key blade. Therefore, the number of possible code levels in the ridge portion 128 (see FIGS. 6 and 7) will be larger than in prior art structures.

It should be noted that the new configuration of the undercut groove 122, with the pocket-like extension 135, is useful even without having a side tumbler 105. Then, the ridge portion is basically continuous and does not have any cuts or codes.

Also, if at least one side tumbler is used, it does not have to be rotatable, but can be guided for elevational movement only. Furthermore, the side tumbler does not have to operate as a locking means for locking the key plug against rotation. Alternatively, it may serve only as a blocking element, which prevents incorrectly cut keys from being fully inserted into the key way 13 of the lock 10. Such a blocking element is disclosed in a patent application being filed by the same applicant on the same day as the earliest priority date of this application.

Figure 10A:
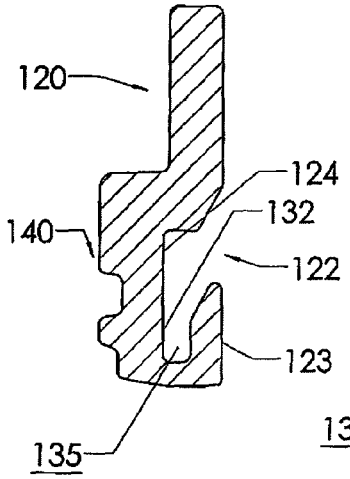

The exact configuration or shape of the longitudinally extending pocket, and the corresponding keyway in the key plug, may be modified in various ways within the scope of the present invention. In FIG. 10*a*, there is shown an embodiment where the inner wall 124 of the longitudinal profile groove 122 merges smoothly with the adjoining lateral wall 132 of the pocket-like configuration 135, without any step (136 in FIG. 7).

Figure 11A:
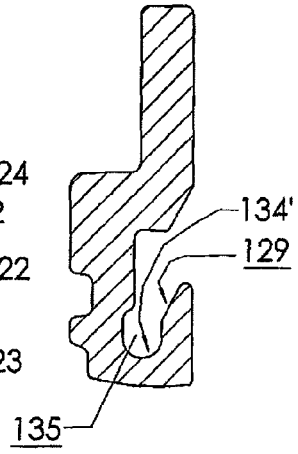

In FIG. 11*a*, the pocket-like configuration 135 is similar to the one in FIG. 7, but the lowermost transverse end wall 134' is slightly rounded or curved.

Figure 12A:
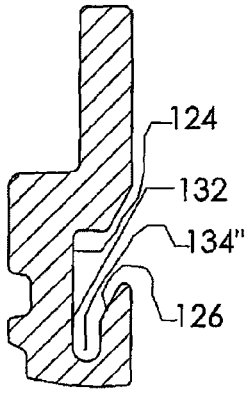
Figure 10B:
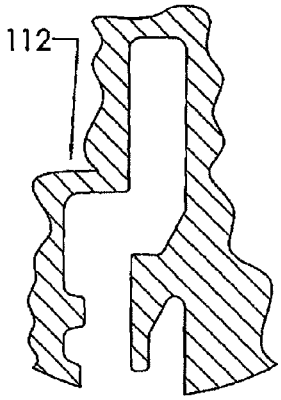
Figure 11B:
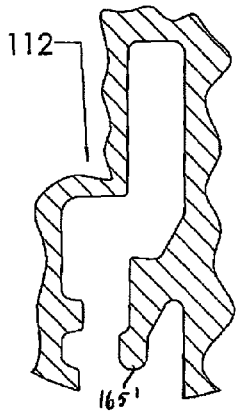
Figure 12B:
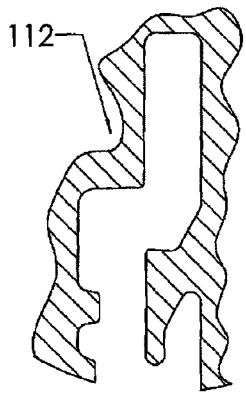
Figure 13B:
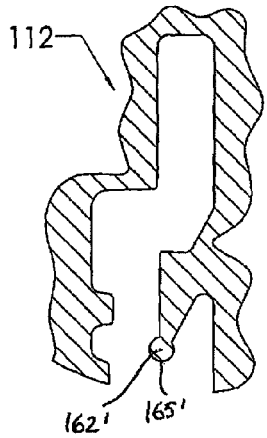
Figure 14B:
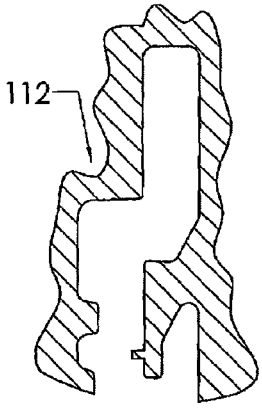
Figure 15B:
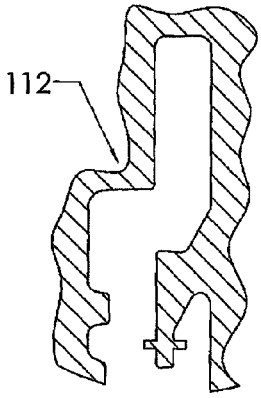
Figure 16B:
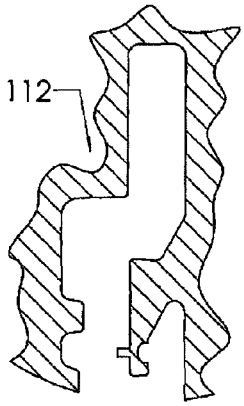
Figure 17B:
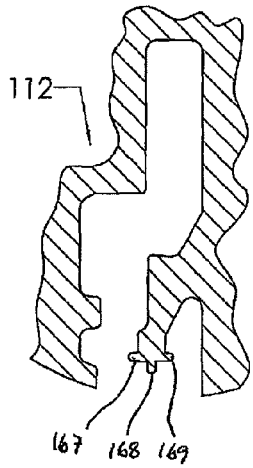

The embodiment shown in FIG. 12*a* is similar to the one in FIG. 11, but the lowermost transverse end wall 134" is shorter (but still curved), and the inner wall 124 of the groove merges smoothly with the adjoining lateral wall 132 (as in FIG. 10).

Figure 13A:
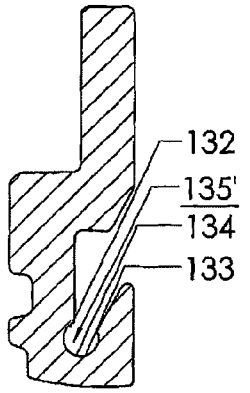

In FIG. 13*a*, the pocket-like configuration 135' is modified into a circular cross-section. Accordingly, in this embodiment, the lateral walls 132, 133 and the lowermost end wall 134 are all formed as circular arcs merging with each other.

Figure 14A:
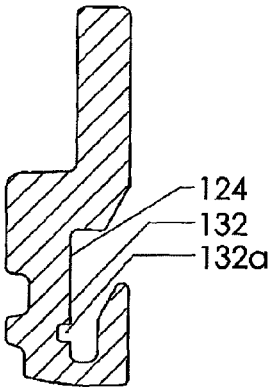

The embodiment shown in FIG. 14*a* is like the one shown in FIG. 10, but the lateral wall 132 adjoining the inner wall 124 is provided with a longitudinal recess 132*a*, which is rectangular in cross-section.

Figure 15A:
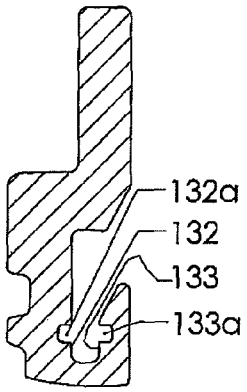

The embodiment of FIG. 15*a* is similar to the one of FIG. 14*a*, but there is also a longitudinal recess 133*a* in the lateral wall 133 opposite to the longitudinal recess 132*a*.

Figure 16A:
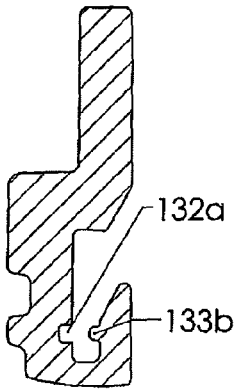

The embodiment in FIG. 16*a* is similar to the one in FIG. 15*a*, but there is a longitudinal rib 133*b* (instead of a recess 133*a*) opposite to the longitudinal recess 132*a*.

Figure 17A:
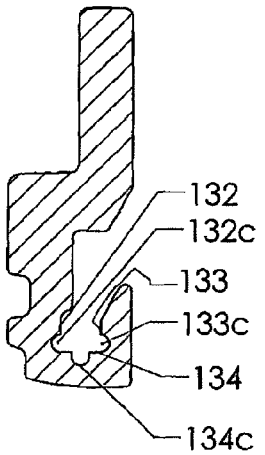

The modified embodiment shown in FIG. 17*a* comprises relatively small longitudinal recesses 132*c*, 133*c*, 134*c* with part-cylindrical cross-sections in the lateral walls 133 and 132 and the lowermost end wall 134, respectively. Except for these part-circular recesses, this embodiment corresponds to the one shown in FIGS. 7*a* and 7*b*.

The embodiments of FIGS. 14*a* through 17*a* are included to illustrate that the opposite lateral wall portions and the lowermost transverse end wall of the longitudinal pocket may be provided with irregular surface portions.

Figure 18A:
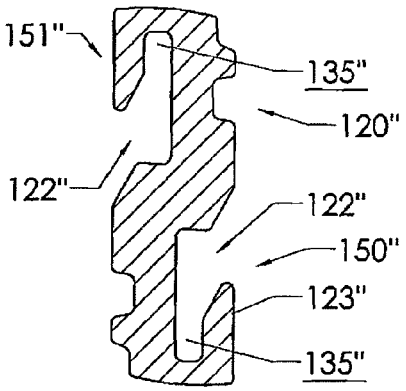
Figure 18B:
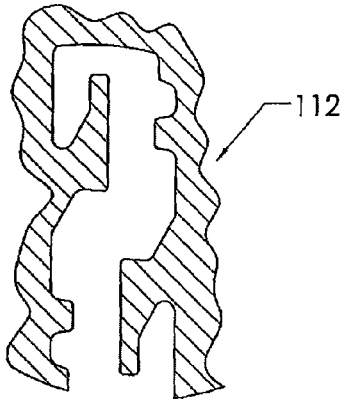
Figure 19A:
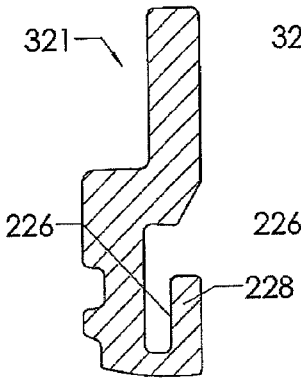

The key blade 120" shown in FIG. 18*a* is composed of a lower part 150", which is identical or similar to the lower parts of the key blades shown in FIGS. 10-17, and an upper part 151", which is identical to the lower part 150", but turned upside down. In this way the key blade 150", 151" can be inserted either way into an associated key hole, either as shown in FIG. 18 or turned upside down (the profile is then exactly the same because of the symmetry of the lower and upper parts).

The keyway in key plug 112 is configured with a geometrical shape which is complementary to the embodiments of FIGS. 10*a* through 18*a*, with exactly the same variations, as illustrated in FIGS. 10*b* through 18*b*.

Finally, FIGS. 19*a* through 27*a* and FIGS. 19*b* through 27*b* show modified embodiments similar to those shown in FIGS. 10*a* through 18*a* and 10*b* through 18*b*. Thus, the keys 321 through 329 and the keyways of the key plug 112 each have a cross-sectional profile corresponding to those shown in FIGS. 10*a* through 18*a* respectively, except that even the upper part of the ridge portion 228 is uniformly thick, and the inside 226 thereof (even at the uppermost part) is parallel to the central plane of the key blade.

Figure 20A:
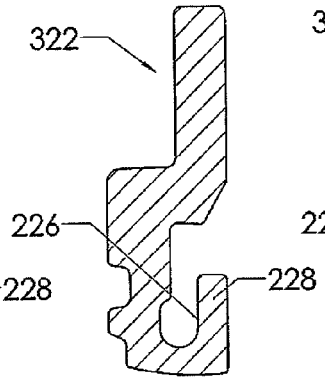
Figure 21A:
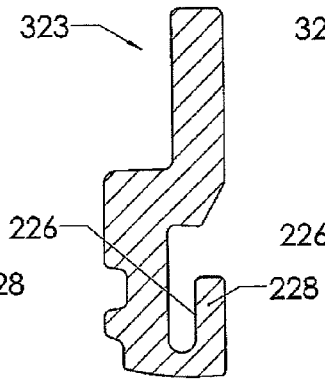
Figure 22A:
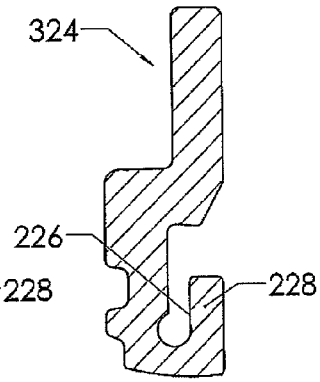
Figure 23A:
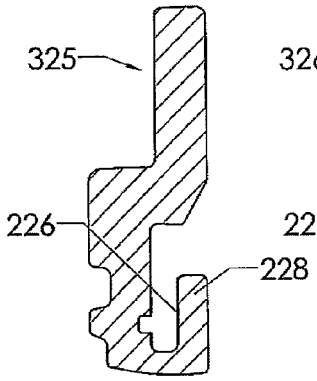
Figure 24A:
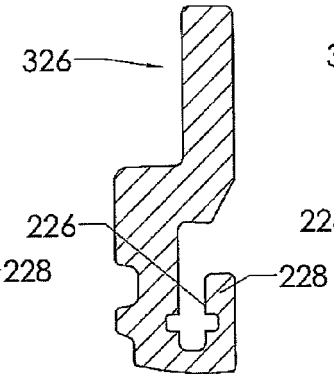
Figure 25A:
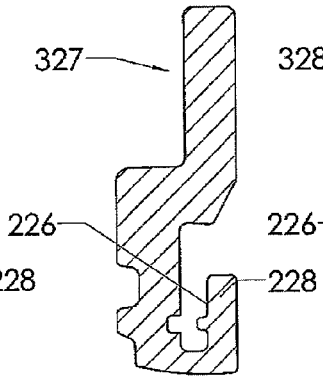
Figure 26A:
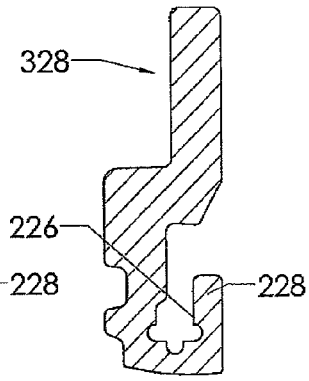
Figure 27A:
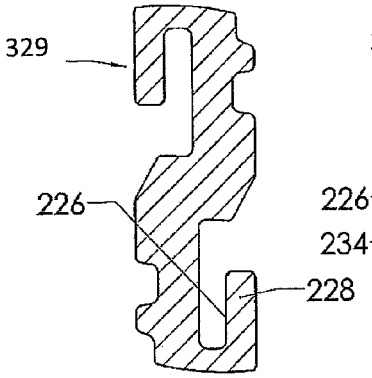
Figure 28A:
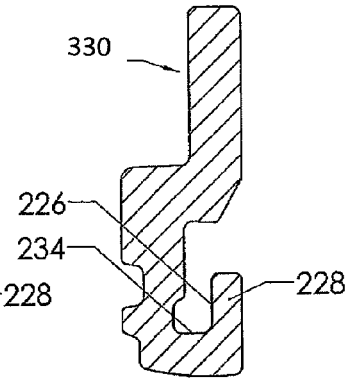
Figure 19B:
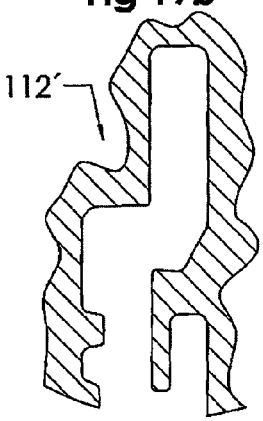
Figure 20B:
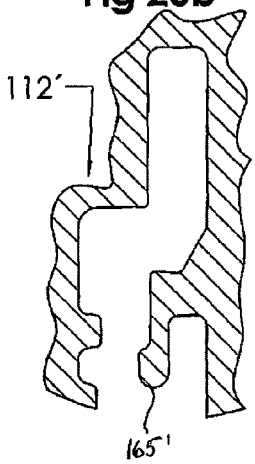
Figure 21B:
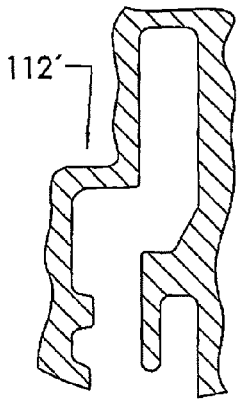
Figure 22B:
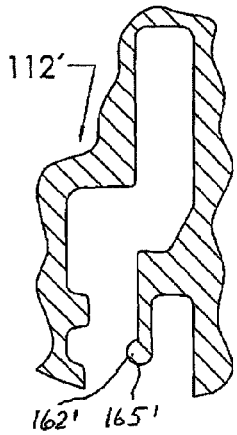
Figure 23B:
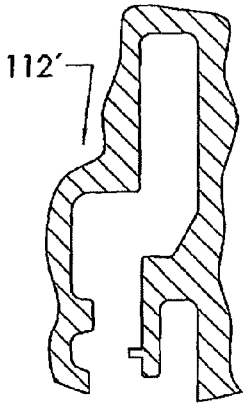
Figure 24B:
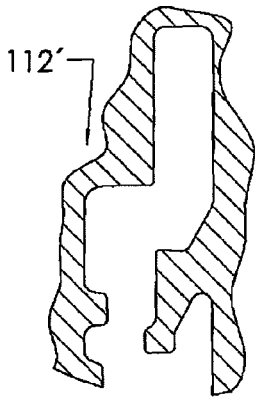
Figure 25B:
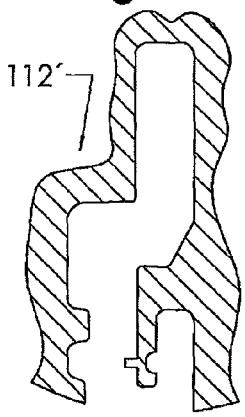
Figure 26B:
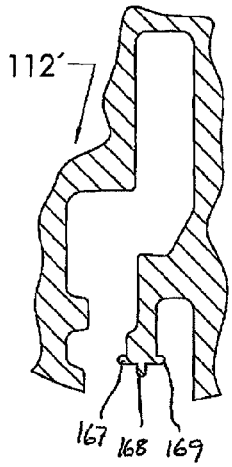
Figure 27B:
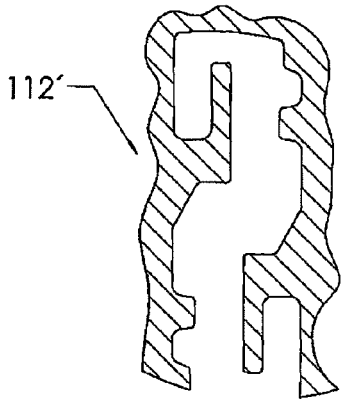
Figure 28B:
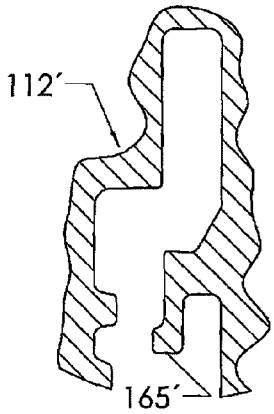

FIGS. 28*a* and 28*b* correspond to FIGS. 20*a* and 20*b*, respectively, except that the lowermost transverse end wall 234 in the key 330 and the corresponding end surface 165' in the keyway of the key plug 112' are flat.

In all embodiments described above, and in the appended claims, it is assumed that the inner wall 124 of the longitudinal undercut groove 122, 122', 122" and the corresponding side surface on the profile rib 150 is substantially parallel to the central plane A of the key blade and a side surface 123, 123' 123" thereof. Within this definition, the inner wall, and the corresponding side surface on the profile rib, may be oriented at a small angle to said central plane A, this angle being no more than 15°.

The longitudinally extending pocket, and the corresponding extension 162 of the tongue 161, may be shorter (in the longitudinal direction) than the length of the key blade and extend along only a portion thereof.

Also, the longitudinal profile rib 150 at the key plug 112 may be interrupted or formed as one or more separate elements mounted in the key plug.

The invention clamed is:

1. A cylinder lock with a rotatable key plug (112) having a profiled keyway (113,116), said keyway being configured to accommodate an elongated, substantially flat key blade (120) having a longitudinal groove (122), wherein said keyway has two opposite lateral sides, which are substantially parallel to each other, and a profile rib (150) projecting outwardly from one of said opposite lateral sides into the keyway, said profile rib having a downwardly projecting tongue portion (161) configured to extend inside said profile groove (122) upon inserting said key (120) into said key plug (112) of the lock, and wherein said tongue portion of the profile rib having a uniform width and extending downwardly from a base portion of said profile rib, down into a lowermost end portion which has two opposite substantially parallel side surfaces and a lowermost transverse end surface which is substantially flat or slightly curved, said lowermost end portion extending downwardly in a direction which is parallel to a central longitudinal plane (A') through said keyway, said lowermost transverse end surface extending substantially in a plane which is substantially perpendicular to a said central longitudinal plane (A'), and the vertical dimension (h') of said downwardly projecting tongue portion (161), measured in a plane parallel to said lateral sides (117,117', 118,118') of said keyway (113,116), is greater than half of the smallest height (w') of said profile rib adjacent to said one lateral side (117,118) of the keyway, also measured in a plane (A') being parallel to said lateral sides of said keyway.

2. The lock as defined in claim 1, wherein said vertical dimension (h') of said tongue portion (161) is greater than said smallest height (w') adjacent to said one lateral side of the keyway.

3. The lock as defined in claim 1, wherein said lowermost end portion (162) of the tongue portion (161) of said profile rib (150) has a substantially rectangular cross-section.

4. The lock as defined in claim 1, wherein said longitudinal profile rib (150) is interrupted so as to form a number of separated profile elements along the keyway.

5. The lock as defined in claim 4, wherein said lock comprises a side locking tumbler (105) having a transversely projecting finger (105*a*) located between two consecutive elements of said profile rib, said side locking tumbler being arranged for vertical movement in said keyway.

6. The lock as defined in claim 5, wherein said side locking tumbler (105) is arranged also for rotational movement between two angular end positions.

7. The lock as defined in claim 1, comprising a longitudinal row of upper and lower locking pins (114*a*,114*b*), arranged to enable rotation of said key plug (112) when each pair of locking pins are located with abutting end surfaces at a shear line between said key plug (112) and a housing (111) of said lock.

8. A cylinder lock with a rotatable key plug (112) having a profiled keyway (113,116), said keyway being configured to accommodate an elongated, substantially flat key blade (120) having a longitudinal groove (122), wherein said keyway has two opposite lateral sides, one of which is substantially flat with a lower part (118) thereof lying substantially in the same plane as an upper part (117) thereof, and a profile rib (150) located at said substantially flat lateral side, said profile rib having a downwardly projecting tongue portion (161) configured to extend inside said profile groove (122) upon inserting said key (120) into said key plug (112)of the lock, and wherein said tongue portion of the profile rib is extended downwardly into a lowermost, massive end portion (162) which has two opposite side surfaces (163,164) and a lowermost transverse end surface (165) which is substantially flat or slightly curved, said lowermost, massive end portion (162) extending downwardly in a direction which is parallel to a central longitudinal plane (A') through said keyway, and said lowermost transverse end surface (165) extending substantially in a plane which is substantially perpendicular to a said central longitudinal plane (A'), wherein at least one of said opposite side surfaces and said lowermost transverse end surface of said lowermost, massive end portion is provided with an irregular surface portion (167,168,169).

9. The lock as defined in claim 8, wherein said lowermost, massive end portion (162) is substantially uniformly wide.

10. The lock as defined in claim 8, wherein the vertical dimension (h') of said tongue portion (161), measured in a plane parallel to said lateral sides (117,117', 118,118') of said keyway (113,116), is greater than half of the smallest height (w') of said profile rib adjacent to said one lateral side (117, 118) of the keyway, also measured in a plane (A') being parallel to said lateral sides of said keyway.

11. The lock as defined in claim 10, wherein said vertical dimension (h') of said tongue portion (161) is greater than said smallest height (w')adjacent to said one lateral side of the keyway.

12. The lock as defined in claim 8, wherein said lowermost, massive end portion (162) of the tongue portion (161) of said profile rib (150) has a substantially rectangular cross-section.

13. The lock as defined in claim 8, wherein said lowermost, massive end portion (162') of the tongue portion of said profile rib has a substantially circular cross-section.

14. The lock as defined in claim 8, wherein said lowermost transverse end surface (165') is curved with a radius being more than half of the width of said lowermost, massive end portion of the tongue portion of said profile rib.

15. The lock as defined in claim 8, wherein said longitudinal profile rib (150) is interrupted so as to form a number of separated profile elements along the keyway.

16. The lock as defined in claim 15, wherein said lock comprises a side locking tumbler (105) having a transversely projecting finger (105a) located between two consecutive elements of said profile rib, said side locking tumbler being arranged for vertical movement in said keyway.

17. The lock as defined in claim 16, wherein said side locking tumbler (105) is arranged also for rotational movement between two angular end positions.

18. The lock as defined in claim 8, comprising a longitudinal row of upper and lower locking pins (114*a*,114*b*), arranged to enable rotation of said key plug (112) when each pair of locking pins are located with abutting end surfaces at a shear line between said key plug (112)and a housing (111) of said lock.

19. A cylinder lock with a rotatable key plug (112) having a profiled keyway (113,116), said keyway being configured to accommodate an elongated, substantially flat key blade (120) having a longitudinal groove (122), wherein said keyway has two opposite lateral sides, which are substantially parallel to each other, and a profile rib (150) projecting outwardly from one of said opposite lateral sides into the keyway, said profile rib having a downwardly projecting tongue portion (161) configured to extend inside said profile groove (122) upon inserting said key (120) into said key plug (112) of the lock, and wherein a lowermost end portion of said tongue portion of the profile rib having an enlarged width relative to a width of a base portion of the profile rib, said lowermost end portion of said tongue portion extending downwardly from the base portion of said profile rib down into a bulbous end portion having a slightly curved lowermost transverse end surface, said lowermost end portion extending downwardly in a direction parallel to a central longitudinal plane (A') through said keyway, said lowermost transverse end surface extending substantially in a plane being substantially perpendicular to a said central longitudinal plane (A').

20. The lock as defined in claim 19, wherein said vertical dimension (h') of said tongue portion (161) is greater than said smallest height (w') adjacent to said one lateral side of the keyway.

21. The lock as defined in claim 19, wherein said lowermost end portion (162') of the tongue portion of said profile rib has a substantially circular cross-section.

22. The lock as defined in claim 19, wherein said lowermost transverse end surface (165') is curved with a radius being more than half of the width of said lowermost end portion of the tongue portion of said profile rib.

23. The lock as defined in claim 19, wherein at least one of said opposite side surfaces and said lowermost transverse end surface of said lowermost end portion is provided with an irregular surface portion (167,168,169).

24. The lock as defined in claim 19, wherein said longitudinal profile rib (150) is interrupted so as to form a number of separated profile elements along the keyway.

25. The lock as defined in claim 24, wherein said lock comprises a side locking tumbler (105) having a transversely projecting finger (105*a*) located between two consecutive elements of said profile rib, said side locking tumbler being arranged for vertical movement in said keyway.

26. The lock as defined in claim 25, wherein said side locking tumbler (105) is arranged also for rotational movement between two angular end positions.

27. The lock as defined in claim 19, comprising a longitudinal row of upper and lower locking pins (114*a*,114*b*), arranged to enable rotation of said key plug (112) when each pair of locking pins are located with abutting end surfaces at a shear line between said key plug (112)and a housing (111) of said lock.

28. A cylinder lock with a rotatable key plug (112) having a profiled keyway (113,116), said keyway being configured to accommodate an elongated, substantially flat key blade (120) having a longitudinal groove (122), wherein said keyway has two opposite lateral sides, which are substantially parallel to each other, and a profile rib (150) projecting outwardly from one of said opposite lateral sides into the keyway, said profile rib having a downwardly projecting tongue portion (161) configured to extend inside said profile groove (122) upon inserting said key (120) into said key plug (112) of the lock, and wherein a lowermost end portion of said tongue portion of the profile rib having an enlarged width relative to a width of a base portion of the profile rib, said lowermost end portion of said tongue portion extending downwardly from the base portion of said profile rib down into an end portion having a slightly curved lowermost transverse end surface and an interior side wall of the tongue portion includes a portion extending at an angle upwardly and outwardly relative to the downward direction of the tongue portion 161, said lowermost end portion extending downwardly in a direction parallel to a central longitudinal plane (A') through said keyway, said lowermost transverse end surface extending substantially in a plane being substantially perpendicular to a said central longitudinal plane (A').

29. The lock as defined in claim 28, wherein said vertical dimension (h') of said tongue portion (161) is greater than said smallest height (w')adjacent to said one lateral side of the keyway.

30. The lock as defined in claim 28, wherein said lowermost, massive end portion (162) is substantially uniformly wide.

31. The lock as defined in claim 28, wherein said lowermost, massive end portion (162) of the tongue portion (161) of said profile rib (150) has a substantially rectangular cross-section.

32. The lock as defined in claim 28, wherein said lowermost end portion (162') of the tongue portion of said profile rib has a substantially circular cross-section.

33. The lock as defined in claim 28, wherein said lowermost transverse end surface (165') is curved with a radius being more than half of the width of said lowermost end portion of the tongue portion of said profile rib.

34. The lock as defined in claim 28, wherein at least one of said opposite side surfaces and said lowermost transverse end surface of said lowermost end portion is provided with an irregular surface portion (167,168,169).

35. The lock as defined in claim 28, wherein said longitudinal profile rib (150) is interrupted so as to form a number of separated profile elements along the keyway.

36. The lock as defined in claim 35, wherein said lock comprises a side locking tumbler (105) having a transversely projecting finger (105*a*) located between two consecutive elements of said profile rib, said side locking tumbler being arranged for vertical movement in said keyway.

37. The lock as defined in claim 36, wherein said side locking tumbler (105) is arranged also for rotational movement between two angular end positions.

38. The lock as defined in claim 28, comprising a longitudinal row of upper and lower locking pins (114*a*,114*b*), arranged to enable rotation of said key plug (112) when each pair of locking pins are located with abutting end surfaces at a shear line between said key plug (112)and a housing (111) of said lock.

* * * * *